US006320562B1

(12) United States Patent
Ueno et al.

(10) Patent No.: US 6,320,562 B1
(45) Date of Patent: Nov. 20, 2001

(54) LIQUID CRYSTAL DISPLAY DEVICE

(75) Inventors: Satoshi Ueno, Yamatokoriyama; Norio Yasunishi, Nara-ken; Koki Taniguchi, Ikoma; Hiroyuki Furukawa, Ueno, all of (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/126,619

(22) Filed: Jul. 31, 1998

(30) Foreign Application Priority Data

Aug. 1, 1997 (JP) ..... 9-208150

(51) Int. Cl.[7] ..... G09G 3/36

(52) U.S. Cl. ..... 345/87; 345/89; 345/98; 345/99; 349/45; 349/48

(58) Field of Search ..... 345/87, 89, 94–96, 345/98–101; 349/45, 48

(56) References Cited

U.S. PATENT DOCUMENTS

| | | | | |
|---|---|---|---|---|
| 5,307,084 | * | 4/1994 | Yamaguchi et al. | 345/58 |
| 5,471,228 | * | 11/1995 | Iicisin et al. | 345/58 |
| 5,670,973 | * | 9/1997 | Bassetti, Jr. et al. | 345/58 |
| 5,940,057 | * | 8/1999 | Lien et al. | 345/89 |

FOREIGN PATENT DOCUMENTS

| | | |
|---|---|---|
| 3-210525 | 9/1991 | (JP) . |
| 4-276794 | 10/1992 | (JP) . |
| 5-46127 | 2/1993 | (JP) . |
| 5-333315 | 12/1993 | (JP) . |
| 6214530 | 8/1994 | (JP) . |
| 6-291848 | 10/1994 | (JP) . |
| 7-120147 | 12/1995 | (JP) . |
| 8115060 | 7/1996 | (JP) . |
| 8-292744 | 11/1996 | (JP) . |

OTHER PUBLICATIONS

"Active Addressing Method for High–Contrast Video–Rate STN Displays," T.J. Scheffer et al., *SID 92 Digest*, pp. 228–231, 1992.

"A New Addressing Technique for Fast Responding STN LCDs," T.N. Ruckmongathan et al., *Japan Display '92 Digest*, pp. 65–67, 1992.

* cited by examiner

*Primary Examiner*—Bipin Shalwala
*Assistant Examiner*—Jimmy H. Nguyen

(57) ABSTRACT

A liquid crystal display device having a plurality of row electrodes to which a scanning voltage is applied; a plurality of column electrodes provided so as to cross the plurality of row electrodes, to which a display data voltage is applied; and a liquid crystal layer interposed between the plurality of row electrodes and the plurality of column electrodes, which provides a display function at intersections between the plurality of row electrodes and the plurality of column electrodes in response to a RMS value of a voltage applied between the plurality of row electrodes and the plurality of column electrodes, includes: a section for outputting a display data signal representing the display data voltage having three or more voltage levels; a compensation circuit for outputting a compensation data signal based on a RMS value difference between the display data voltage and a respective resultant display data voltage applied to the plurality of column electrodes; and a driving circuit for applying a compensation voltage to at least one of the plurality of column electrodes based on the compensation data signal.

9 Claims, 10 Drawing Sheets

LIQUID CRYSTAL DISPLAY DEVICE

BACKGROUND OF THE INVENTION

1. Field of the Invention

The present invention relates to a liquid crystal display device. More particularly, the present invention relates to a driving circuit which solve the problem of deterioration in a display quality, thereby realizing a uniform display quality in an active matrix type liquid crystal display device used in a variety of office automation devices including personal computers and word processors, multimedia information terminals, audio vidual devices, game machines, and the like.

2. Description of the Related Art

In recent years, due to the advent of the highly-informationalized society, demand for a display capable of displaying a large amount of information at once has been rapidly increased. Conventionally, a CRT (cathode ray tube) has been generally used for displaying a large amount of information. However, the CRT is generally large in size and consumes a large amount of power. Since the CRT is made as a stationary type device, the CRT is not suitable for use as a portable device. On the other hand, a flat display such as a liquid crystal display device is thin, and is light in weight. Such characteristics of the flat display are attracting attention.

Liquid crystal display devices are roughly classified into two groups, i.e., a passive matrix type and an active matrix type. A super twisted nematic (hereinafter, referred to as "STN") liquid crystal display device which is a typical passive matrix type liquid crystal display device and a thin film transistor (hereinafter, referred to as "TFT") liquid crystal display device which is a typical active matrix type liquid crystal display device will be described hereinafter.

The TFT liquid crystal display device includes switching elements such as TFTs which are positioned at intersections of row electrodes and column electrodes arranged in an matrix. Display is performed by controlling the switching element so as to independently apply a voltage to a liquid crystal layer in each of pixels. In such a TFT liquid crystal display device, liquid crystals are operated in a TN mode. Thus, it is possible to realize both a high contrast and high-speed response.

According to the STN liquid crystal display device, on the other hand, a liquid crystal layer is interposed between a pair of glass substrates on which row electrodes and column electrodes are provided so as to cross each other. A display is realized by changing optical state of the liquid crystal layer depending on an RMS voltage level of a driving voltage which is applied between the row electrodes and the column electrodes.

If these two types of the liquid crystal display devices are compared with each other in terms of their costs, the STN liquid crystal display device is superior to the TFT liquid crystal display device due to its simple panel structure and fabrication process.

As to their display performances, however, the TFT liquid crystal display device has an advantage over the STN liquid crystal display device which has no switching element associated with a pixel. In particular, the STN liquid crystal display device tends to have a deteriorated display quality as its display capacity increases. This is because as its display capacity increases, its driving margin reduces, thereby reducing its contrast ratio, and display unevenness which depends on its display pattern, i.e., cross-talk, occurs.

Regarding their optical response performances, the optical response speed of the STN liquid crystal display device is generally about 300 ms, whereas that of the TFT liquid crystal display device is about 50 ms. Therefore, the STN liquid crystal display device has an optical response speed slower than that of the TFT liquid crystal display device, and thus is not suitable for displaying a moving picture. Moreover, in the STN liquid crystal display device, its contrast ratio tends to reduce as its response speed increases.

As described above, both types of the liquid crystal display devices have their advantages and disadvantages. Along with an increase in the use of multimedia, however, even the relatively inexpensive STN liquid crystal display device came to be required to display a moving picture (e.g., a video picture, a picture, or the like). Needs for a high-speed responsiveness and a high picture quality are increasing.

Hereinafter, the cause of a reduction in its contrast in the STN liquid crystal display device having a high-speed responsiveness and a technique for improving the problem will be described.

The STN liquid crystal display device conventionally employs a line-sequential driving method. This driving method sequentially scans a group of row electrodes one line at a time during one frame period. Upon scanning, a high level scanning pulse is applied to each of the row electrodes only once in the one frame period. Synchronizing with the application of the high level scanning pulse, a data voltage which complies with display data in each pixel related to the scanned row electrode is applied to a column electrode.

It is intended that the liquid crystal display device employing the conventional line-sequential driving method mainly displays a still picture or the like. Such a liquid crystal display device conventionally uses a liquid crystal material having a relatively low response speed. In such a case, the liquid crystal molecules respond to an applied RMS (root-mean-square) voltage (i.e., effective voltage), thereby obtaining a practical contrast ratio. However, if high speed responsiveness of the liquid crystal layer is realized by reducing the liquid crystal viscosity or reducing a thickness of the liquid crystal layer in order to realize the display of a moving picture, the liquid crystal molecules respond not to the RMS voltage (i.e., effective voltage) but to a driving waveform itself according to the line-sequential driving method. As a result, the phenomenon in which a transmittance varies for each of the frames becomes prominent. This phenomenon is referred to as a "frame response phenomenon". The frame response phenomenon leads to a significant reduction in the contrast ratio.

In order to improve such a problem, unlike the line-sequential driving method in which the high level scanning pulse is applied only once in the one-frame period, a driving method in which the high level scanning pulse is divided into a plurality of low level scanning pulses and applied in the plurality of times in one frame, thereby suppressing the frame response phenomenon to prevent the reduction in the contrast ratio has been suggested. Such a driving method is referred to as a multiline selection driving method. Such a driving method is characterized in that a plurality of row electrodes are simultaneously scanned using an orthogonal matrix. Hereinafter, the fundamental operation thereof will be briefly described.

After performing an orthogonal transformation operation for input image data by using the orthogonal matrix, a data voltage based on its arithmetic data is applied to a column electrode. In synchronization with the application of the data voltage, a scanning voltage based on a column vector of the orthogonal matrix is applied to all of the simultaneously-selected row electrodes at the same time. In this manner, the orthogonal inverse transformation of an image data is performed on the liquid crystal panel. As a result, the input image can be reproduced. Depending on the number of the row electrodes which are simultaneously selected, their scanning order, or the like, the following three driving methods have been suggested. However, the fundamental principals thereof are as described above.

The first driving method is an active addressing method in which all of row electrodes for an entire display screen are simultaneously scanned. This method is disclosed in T. J. Scheffer et al. (SID '92, Digest, p. 228), Publication for Opposition No. 7-120147, and the like.

The second driving method is a sequency addressing method in which a plurality of row electrodes which are fewer than the total number of row electrodes for an entire display screen are grouped, and the resulting groups are scanned in a sequential manner. The sequency addressing method can have a smaller circuit as compared to the active addressing method. This second driving method is disclosed in T. N. Ruckmongathan et al. (Japan Display '92, Digest, p. 65), Japanese Laid-open Publication No. 5-46127, and the like.

According to the third driving method disclosed, for example, in Japanese Laid-open Publication No. 6-291848, a screen is divided into a plurality of blocks along the row direction; a plurality of row electrodes which are fewer than the total number of row electrodes in each of the blocks are grouped; and the resulting groups are sequentially scanned so as to drive all of the blocks. This third driving method can further reduce a memory capacitance as compared to the second driving method. Therefore, the third driving method can realize a circuit smaller than that employed by the second driving method.

As described above, by employing the multiline selection driving method for the passive matrix type liquid crystal display device having a high-speed responsiveness, it becomes possible to suppress the frame response phenomenon and improve the reduction of the contrast ratio.

Next, the cross-talk, which depends on a display pattern, will be described in the case where the liquid crystal display device employs the multiline selection driving method as an example.

FIG. 6 schematically illustrates a liquid crystal display device 100' employing the conventional multiline selection driving method. As shown in FIG. 6, the liquid crystal display device 100' includes a timing control circuit 1', a frame memory 2', an orthogonal matrix generator 3, an orthogonal transformation circuit 4, a group 7 of row drivers, a group 8U of column drivers for the upper section of a screen, a group 8L of column drivers for the lower section of the screen, and a liquid crystal panel 9. The liquid crystal panel 9 has row electrodes 91 (the number of the row electrodes 91 is 2×N) and M column electrodes 92 which are arranged so as to cross the row electrodes 91, where N=(1, 2, . . . , n), and M=(1, 2, . . . , n). The intersections of the row electrodes 91 and the column electrodes 92 are arranged in a matrix. A liquid crystal layer (not shown) is interposed between the row electrodes 91 and the column electrodes 92, and each intersection of the row electrode 91 and the column electrode 92 respectively corresponds to each pixel. The liquid crystal layer in each of the pixels changes its optical state depending on an RMS voltage level of a driving voltage which is applied between the row electrodes 91 and the column electrodes 92. In this manner, display is performed.

The passive matrix type liquid crystal display device has a tendency that an operation margin represented by the following Expression 1 reduces as the number of the row electrodes increases (i.e., as N increases), thereby reducing the passive matrix type liquid crystal display's contrast ratio.

[Expression 1] (1)

$$\frac{V_{ON}}{V_{OFF}} = \sqrt{\frac{\sqrt{N}+1}{\sqrt{N}-1}}$$

Accordingly, upon performing mass display, a dual-scan type liquid crystal panel wherein a screen is divided into two sections as shown in FIG. 6 and each of the two sections is independently driven are generally used. Although the case where the upper section of the screen is driven will be described hereinafter, the same process is performed in order to drive the lower section of the screen.

Display data S101 is input to the frame memory 2' in a single scanning manner. Specifically, the display data S101 is written to the frame memory 2' for every row. Since the liquid crystal display device 100' employs the multiline selection driving method, display data written to the frame memory 2' is read out as follows. L×M (rows×columns) display data S201 corresponding to L row electrodes 91 which are simultaneously selected in N×M display data for a screen (i.e., the upper section of the screen) is read out for every column, and then output to the orthogonal transformation circuit 4. In this manner, display data is written along the row direction, and read out along the column direction according to the multiline selection driving method. The orthogonal matrix generator 3 generates an orthogonal matrix, and outputs a column vector S301 of the generated orthogonal matrix to the orthogonal transformation circuit 4 and the group 7 of row drivers so as to make the matrix correspond to display data S201 which is read out from the frame memory 2'.

The orthogonal transformation circuit 4 receives data S201 which is output from the frame memory 2'. By using column vector S301 of an orthogonal matrix, which corresponds to data S201, orthogonal transformation operation is performed. Its arithmetic data S401 is output to the group 8U of column drivers for the upper section of the screen.

Based on the column vector S301 of the orthogonal matrix which is output from the orthogonal matrix generator 3, the group 7 of row drivers applies a scanning voltage, which is enough for L electrodes, to the row electrodes 91 of the liquid crystal panel 9 such that the scanning voltage corresponds to arithmetic data S401. Similarly, the group 8U of column drivers for the upper section of the screen applies a data voltage to the column electrodes 92 of the liquid crystal panel 9 based on arithmetic data S401, which is output from the orthogonal transformation circuit 4.

As shown in FIG. 6, the liquid crystal panel 9 is a dual-scan type liquid crystal panel wherein the panel is divided into two sections, i.e., the upper section of the panel and the lower section of the panel, and the two sections are driven independent of each other. N row electrodes are provided for each of the upper and lower sections of the panel 9. The group 7 of row drivers consists of a plurality of row drivers 7-1, 7-2, . . . , 7-Y depending on the number of the row electrodes 91, i.e., N. Based on the column vector S301 of the orthogonal matrix which is output from the orthogonal matrix generator 3, the group 7 of row drivers sequentially applies a scanning voltage, which is enough for simultaneously-selected L row electrodes, to the row electrodes 91. Similarly, the group 8U of column drivers for the upper section of the screen includes a plurality of column drivers 8U-1, 8U-2, . . . , 8U-X depending on the number of the column electrodes 92, i.e., M, and applies a data voltage based on arithmetic data S401 which is output from the orthogonal transformation circuit 4 to M column electrodes 92 simultaneously. As a result, the orthogonal inverse transformation of display data is performed on the liquid crystal panel 9, thereby realizing the display of data.

The timing control circuit 1' controls a timing for the entire system of the liquid crystal display device 100'.

Each of driving circuits in the thus-structured liquid crystal display device 100' employing the multiline selection driving method will be described taking the case where the number of simultaneously-selected row electrodes is set to four as an example.

FIGS. 7A and 7B are timing charts showing control for the operation of the frame memory 2'. FIG. 7A is a diagram for describing the writing operation to the frame memory 2'. FIG. 7B is a diagram for describing the reading operation from the frame memory 2'. In FIGS. 7A and 7B, a "Vsync signal" refers to a vertical synchronous signal, and a "Hsync signal" refers to a horizontal synchronous signal. Both of these signals are input with display data S101. One cycle of the Vsync signal is referred to as "a vertical scanning period", and one cycle of the Hsync signal is referred to as "a horizontal scanning period".

As shown in FIG. 7A, in the case where display data for 2×N rows is input, an Enable signal, indicating the period during which display data is effective, maintains a level H only during consecutive 2×N horizontal scanning periods in a vertical scanning period. Display data is input to the frame memory 2' in a single scanning manner according to the Enable signal, and written to the frame memory 2'. Herein, input data from 1 to N is display data for the upper section of the screen, and input data from N+1 to 2×N is display data for the lower section of the screen. In a vertical scanning period, a horizontal scanning period in which the Enable signal is not effective is called a "vertical interval". A plurality of consecutive horizontal scanning periods are generally included in a vertical interval.

FIG. 7B is a diagram for describing the reading operation of display data for the upper section of the screen from the frame memory 2'. Since the liquid crystal panel 9 employed in this example is a dual-scan type panel wherein the upper section of the panel and the lower section of the panel are simultaneously driven, display data input in a single scanning manner is read out twice in one vertical scanning period if the reading operation is processed in the same clock frequency as that of the writing operation. Hereinafter, a reading period of display data read out at a time is referred to as "one frame period". For an every frame period, display data of four rows which are simultaneously selected is read out from the frame memory 2' four times, and output to the orthogonal transformation circuit 4. It is required that the reading period has 2×N=((N rows/4 rows)×4 times×2 frames) horizontal scanning periods in one vertical period. FIG. 8 shows an exemplary structure of the orthogonal transformation circuit 4. d0 to d3 shown in FIG. 8 represent four rows of display data S201 which is read out from the frame memory 2'. In the case of two-gray-scale display (i.e., black-and-white display), each of d0 to d3 is represented by one bit of "0" or "1". The set of f0 to f3 is a column vector S301 of the orthogonal matrix which is output from the orthogonal matrix generator 3, and each of f0 to f3 is represented by one bit of "0" or "1". Then, the orthogonal transformation operation represented by the following Expression 2 is performed to derive its arithmetic values G (g0, g1, g2).

[Expression 2] (2)

$$G = \sum_{i=0}^{3} di \cdot fi$$

Table 1 shows the relationship among an arithmetic value G, arithmetic data S401, and an output data voltage. As shown in Table 1, an arithmetic value G is an integer from 0 to 4. Therefore, as shown in FIG. 8, the arithmetic values G are output as 3-bit arithmetic data S401 from g0 to g2 to the group 8U of column drivers for the upper section of the screen. A data voltage corresponding to arithmetic data S401 is applied to the column electrodes 92 of the liquid crystal panel 9 via the group 8U of column drivers for the upper section of the screen.

TABLE 1

| Arithmetic value | Arithmetic data (upper← →lower) | Output data voltage |
|---|---|---|
| 0 | 000 | −2Vc |
| 1 | 001 | −Vc |
| 2 | 010 | 0 |
| 3 | 011 | +Vc |
| 4 | 100 | +2Vc |

For reference, exemplary truth value tables for full adder and half adder are shown below.

Full adder

| Input | | | Carry | Sum |
|---|---|---|---|---|
| A | B | I | C | S |
| 0 | 0 | 0 | 0 | 0 |
| 0 | 0 | 1 | 0 | 1 |
| 0 | 1 | 0 | 0 | 1 |
| 0 | 1 | 1 | 1 | 0 |
| 1 | 0 | 0 | 0 | 1 |
| 1 | 0 | 1 | 1 | 0 |
| 1 | 1 | 0 | 1 | 0 |
| 1 | 1 | 1 | 1 | 1 |

Half adder

| Input | | Carry | Sum |
|---|---|---|---|
| A | B | C | S |
| 0 | 0 | 0 | 0 |
| 0 | 1 | 0 | 1 |
| 1 | 0 | 0 | 1 |
| 1 | 1 | 1 | 0 |

FIG. 9 is a view for describing how cross-talk, which depends on a display pattern, occurs on the liquid crystal panel 9 in the liquid crystal display device 100' employing the multiline selection driving method, which is driven in the manner as described above.

FIG. 9 shows display states of the liquid crystal panel 9. Herein, pixels indicated by white color are in a lighting state, and pixels indicated by black color are in a non-lighting state. Areas shown by oblique lines indicate pixels which fail to be in the bright state due to a reduced transmittance caused by cross-talk. Reference numeral Y1 denotes any one of the group of row electrodes, and two column electrodes which cross the row electrode Y1 are denoted by X1 and X2. Pixels positioned at the intersections of the row electrode Y1 and the column electrodes X1 and X2 are denoted by P1 and P2, respectively. For the convenience of illustration, distortion in the waveform of a scanning voltage at pixel P1 and that in pixel P2 are supposed to be the same.

Each of FIGS. 10A and 10B shows exemplary waveforms of data voltages which are applied to the column electrodes X1 and X2 in FIG. 9. FIG. 10A shows actual voltage waveforms, and FIG. 10B shows ideal voltage waveforms. The "ideal voltage waveform" as used herein refers to a predetermined voltage waveform desirable to apply across a liquid crystal layer in a pixel region. Since the pixel region has a capacitance and resistance, the waveform of a voltage actually applied across the liquid crystal layer (shown in FIG. 10A) is different from the predetermined voltage waveform desirable to apply across a liquid crystal layer shown in FIG. 10B.

As is apparent from the ideal voltage waveforms shown in FIG. 10B, RMS voltages which are identical with each other in the ideal state are respectively applied across pixels P1 and P2 associated with the common row electrode Y1. Therefore, no difference should occur in the transmittances of the liquid crystal panel at pixels P1 and P2. In reality, however, due to the resistance component of the electrode or the capacitance component of the liquid crystal layer, distorted waveforms as shown in FIG. 10A are applied across the pixels of the liquid crystal panel.

As described above, due to the difference in display patterns, differences occur among distortion levels in waveforms of data voltages which are respectively applied across column electrodes. As a result, as shown in FIG. 9, even when the same bright state is achieved at both of pixels P1 and P2, pixel P1 associated with the column electrode X1, which has a large distortion level in its data voltage waveform, has a reduced transmittance as compared to pixel P2 associated with the column electrode X2, which has a smaller distortion level in its data voltage waveform. Due to the reduced transmittance, the display becomes dark. In this manner, cross-talk occurs in pixel P1. Since the cross-talk which depends on a display pattern significantly deteriorates the display quality, cross-talk is a very important problem to be solved in the passive matrix type liquid crystal display device.

Accordingly, in order to overcome the problem of such cross-talk, the following two techniques have been suggested for the line-sequential driving method.

According to the first technique, a period during which a data voltage waveform is inverted is provided every predetermined horizontal scanning period. As a result, even when waveform distortion due to its display pattern does not exist, the waveform of the data voltage is made distorted, thereby uniformalizing the distortion levels of the waveform to some extent. This technique is disclosed in Japanese Laid-open Publication Nos. 5-333315 and 4-276794, and the like.

The second technique is a method in which a compensation voltage corresponding to a reduced amount of an RMS voltage accompanied by waveform distortion for every column electrode is applied depending on the number of changes in the polarity of the data voltage. This technique is disclosed in Japanese Laid-open Publication No. 3-210525 and Japanese Patent Application No. 7-98825, and the like.

However, the aforementioned techniques for solving the cross-talk which depend on a display pattern have problems as described below.

According to the aforementioned first technique, transmittance of the entire liquid crystal panel is reduced, thereby reducing its contrast ratio.

Moreover, data voltage waveforms, which are applied to column electrodes in a background display region where most of all the column electrodes in the entire liquid crystal panel are provided, simultaneously change in all scanning periods. As a result, a large level of waveform distortion is generated in the row electrodes via the capacitance of the liquid crystal layer. Consequently, cross-talk which is different from the aforementioned cross-talk in kind is increased. This kind of cross-talk becomes more prominent as a potential change in the column electrodes increases. Thus, the first technique is not suitable for the multiline selection driving method wherein a data voltage is higher than that in the line-sequential driving method.

Furthermore, the first technique causes a waving phenomenon wherein a scanning line looks as if it is flowing for every cycle in which the data voltage waveform is inverted. Although there is only one scanning line according to the line-sequential driving method, a plurality of scanning lines exist according to the multiline selection driving method. Therefore, the waving phenomenon becomes more prominent in the case where the multiline selection driving method is employed. Although the waving phenomenon is less apparent in the liquid crystal panel having relatively slow responsiveness, the waving phenomenon appears to be more prominent in the liquid crystal panel having high-speed responsiveness. This is because the tendency of the liquid crystal to respond to the scanning pulse intensifies if the data voltage waveform is inverted in the same cycle as that in the liquid crystal panel having a relatively slow responsiveness. Regarding such a point, the multiline selection driving method also has a disadvantage over the line-sequential driving method.

According to the aforementioned second technique, the number of possible values a data voltage can take is increased in the multiline selection driving method as compared to the line-sequential driving method.

According to the line-sequential driving method, a data voltage takes only two values, i.e., the data voltage for on-display and the data voltage for off-display. Therefore, it is possible to count the number of changes in the polarity of a data voltage. Thus, the result of such a counting has a one-to-one correspondence with the display data.

According to the multiline selection driving method, on the other hand, a data voltage can take many values (i.e., the number of selected lines+1). For example, in the case where four row electrodes are simultaneously driven, five values are needed as shown in Table 1. Since the case where a data voltage has no polarity, i.e., the case where the data voltage is 0, is included among the five values, the second technique in which changes in polarity are counted cannot be applied to the multiline selection driving method.

Specifically, in the line-sequential driving method, a data voltage takes only two values with respect to the non-selection level of a scanning signal, i.e., +V or −V. Therefore, in both of the cases where the data voltage changes from +V to −V and where the data voltage changes form −V to +V, the amounts of waveform distortion (i.e., the required amounts of compensation) are the same. In other words, the total amount of required compensation is proportional to the number of changes in the polarity of the waveform. On the other hand, in the multiline (2 or more lines) selection driving method, the possible levels of a data voltage are three or more (i.e., the number of selected lines+1). In the case where four lines are simultaneously selected, for example, a data voltage takes five values with respect to the non-selection level of the scanning signal, i.e., −2V, −V, 0, +V, and +2V. In such a case, the case where a data voltage level changes from −2V to +V and the case where a data voltage level changes from −2V to +2V, for example, are the same in terms of their polarity change, i.e., a change from a negative value to a positive value. However, amounts of their required compensation are different from each other. In the case where a data voltage level changes from +V to +2V, its polarity does not change. However, since its waveform changes, compensation in an amount corresponding to the waveform distortion is necessary. (In addition, in the case where a data voltage level changes from 0, which has no polarity, to a positive or negative value, or in the case where a data voltage level changes from a positive or negative value to 0, which has no polarity, it is necessary to determine as to whether the polarity is changed or not changed.) As described above, according to the multiline selection driving method, the required compensation amount is not necessarily proportional to the number of changes in the polarity of a data voltage. As a result, simply applying a compensation voltage corresponding to the number of changes in its polarity is not appropriate compensation.

According to a method in which compensation is performed by newly providing a compensation voltage, since a data voltage takes two values in the case of the line-sequential driving method, when a compensation voltage is newly provided in each of the data voltage levels, for example, the data voltage takes four values in total. Therefore, compensation can be relatively easily performed. However, in the case where the same processing is performed in the multiline selection driving method, since a data voltage takes many values, it is difficult to newly provide compensation voltages.

As described above, in the case where the multiline selection driving method is employed for the passive matrix type liquid crystal display device having high-speed responsiveness, it is extremely difficult to employ techniques which have been applied for the conventional line-sequential driving method. Therefore, it is impossible to solve the problem of cross-talk sufficiently.

SUMMARY OF THE INVENTION

According to one aspect of this invention, a liquid crystal display device having a plurality of row electrodes to which a scanning voltage is applied; a plurality of column electrodes provided so as to cross the plurality of row electrodes, to which a display data voltage is applied; and a liquid crystal layer interposed between the plurality of row electrodes and the plurality of column electrodes, which provides a display function at intersections between the plurality of row electrodes and the plurality of column electrodes in response to a RMS value of a voltage applied between the plurality of row electrodes and the plurality of column electrodes, includes: a section for outputting a display data signal representing the display data voltage having three or more voltage levels; a compensation circuit for outputting a compensation data signal based on a RMS value difference between the display data voltage and a respective resultant display data voltage applied to the plurality of column electrodes; and a driving circuit for applying a compensation voltage to at least one of the plurality of column electrodes based on the compensation data signal.

In one embodiment of the present invention, the compensation circuit includes a compensation value circuit for generating a desired compensation value corresponding to a predetermined period based on a level and a direction of change in the display data voltage; and the compensation data signal is output based on the desired compensation value.

In another embodiment of the present invention, a comparison circuit for selecting a first predetermined compensation value corresponding to the compensation data signal based on a first desired compensation value during a first compensation processing period; and an offset circuit for adding a difference between the first selected predetermined compensation value and the first desired compensation value to a second desired compensation value during a second compensation processing period are further included.

In still another embodiment of the present invention, the driving circuit applies the compensation voltage during a predetermined period of time.

In still yet another embodiment of the present invention, the compensation circuit includes a plurality of compensation amount determinant circuits for determining a compensation amount based on the RMS value difference, and a selection circuit for selecting one of the plurality of compensation amount determinant circuits for every compensation processing period.

According to another aspect of this invention, a liquid crystal display device having a plurality of row electrodes to which a scanning voltage is applied; a plurality of column electrodes provided so as to cross the plurality of row electrodes, to which a display data voltage is applied; and a liquid crystal layer interposed between the plurality of row electrodes and the plurality of column electrodes, which provides a display function at intersections between the plurality of row electrodes and the plurality of column electrodes in response to a RMS value of a voltage applied between the plurality of row electrodes and the plurality of column electrodes, includes: a compensation circuit for outputting a compensation data signal for compensating for a change in a RMS value caused by a waveform change of the display data voltage applied to at least the one of the plurality of column electrodes; and a data output circuit for outputting a display data signal and the compensation data signal to a driving circuit for at least one of the plurality of column electrodes during one frame period.

In one embodiment of the present invention, a plurality of the compensation data signals are output during the one frame period.

In another embodiment of the present invention, the compensation voltage and the display data voltage have a plurality of same voltage levels.

In still another embodiment of the present invention, the driving circuit applies the compensation voltage during a predetermined period of time.

The liquid crystal display device according to the present invention includes a compensation circuit for generating a compensation data signal based on a RMS value difference between a display data voltage and a respective resultant display data voltage, and a driving circuit for applying a compensation voltage to one of the plurality of column electrodes based on the compensation data signal. As a result, display data voltage close to its predetermined or ideal voltage can be applied to the column electrodes.

Another liquid crystal display device according to the present invention includes: a compensation circuit for generating a compensation data signal for compensating for a change in a RMS value caused by a waveform change of a voltage applied to one of the plurality of column electrodes; and a driving circuit for applying the display data voltage and a compensation voltage based on the compensation data signal to one of the plurality of column electrodes during one frame period. As a result, a RMS value which increases or decreases according to the waveform change of the voltage applied to one of the column electrodes can be compensated.

The liquid crystal display device of this invention includes an offset circuit for adding a difference between a first selected predetermined compensation value and a first desired compensation value to a second desired compensation value during a second compensation processing period. Therefore, the difference between the first selected predetermined compensation value and the first desired compensation value can be compensated as a whole.

The compensation circuit has a plurality of different sections for calculating a compensation voltage. The switching circuit selects one of the plurality of sections for calculating a compensation voltage for every compensation processing period. The section for calculating a compensation voltage obtains a compensation voltage using a different look up table for every frame. The plurality of sections for calculating a compensation voltage refer to different look up tables, respectively.

The compensation voltage may have a plurality of voltage levels, and the display data voltage may have the plurality of voltage levels. Therefore, it is possible to generate the compensation voltage and the display data voltage by the same power source.

The driving circuit applies the compensation voltage to one of the plurality of column electrodes during a predetermined period of time. As a result, a RMS value of a display data voltage can be compensated so as to be sufficiently close to the RMS value of its predetermined voltage.

Thus, the invention described herein makes possible the advantages of providing (1) a liquid crystal display device capable of significantly reducing cross-talk depending on a display pattern, which is caused by a change in the waveform of a voltage applied for every column electrode, even when a multiline selection driving method is employed; and providing (2) a method for driving the same.

These and other advantages of the present invention will become apparent to those skilled in the art upon reading and understanding the following detailed description with reference to the accompanying figures.

DESCRIPTION OF THE PREFERRED EMBODIMENTS

Hereinafter, the present invention will be described by way of illustrative, but non-limiting examples with reference to the accompanying drawings.

Embodiment 1

Figure 1:
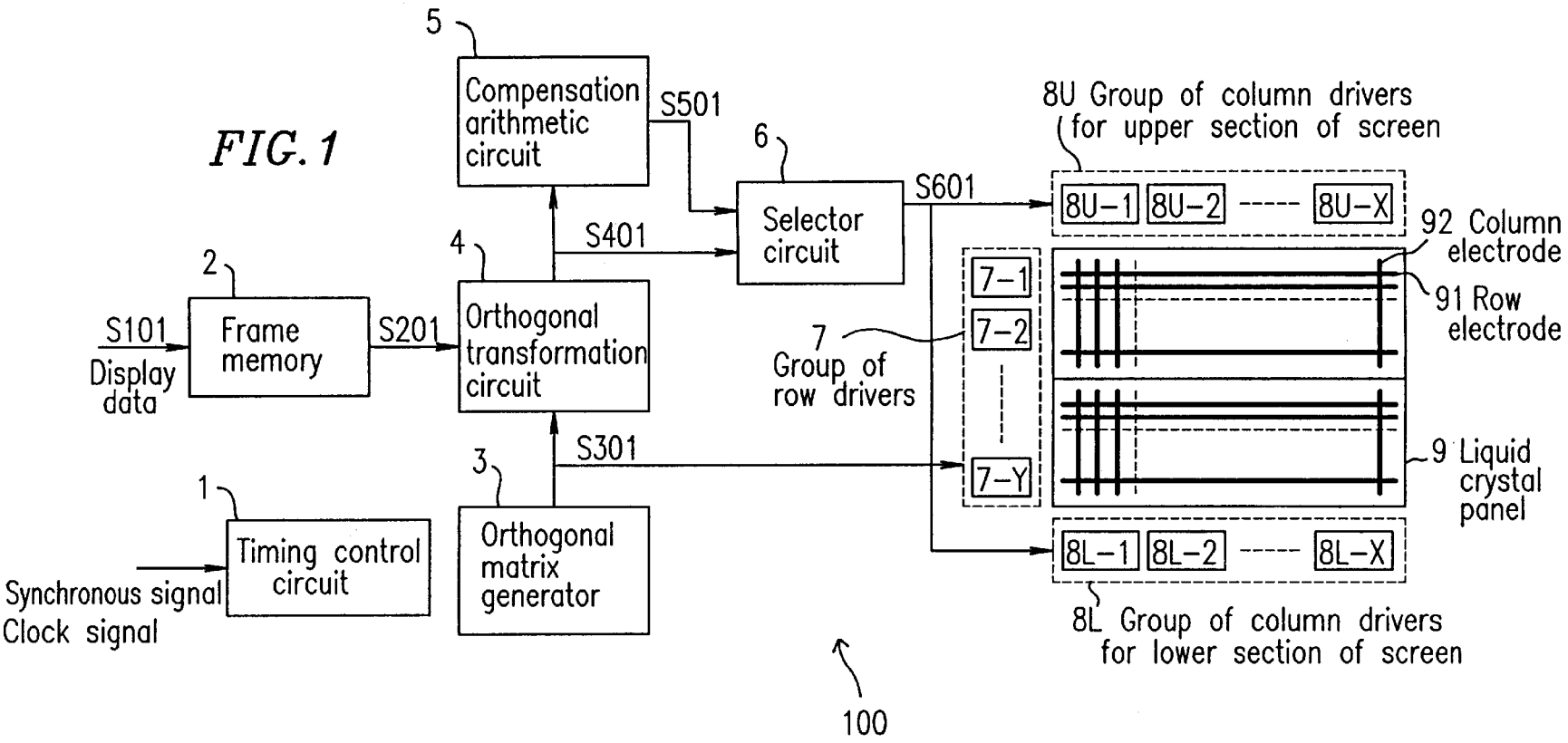
FIG. 1 is a diagram showing an exemplary liquid crystal display device according to the present invention.

FIG. 1 schematically illustrates a liquid crystal display device 100 employing the multiline selection driving method according to Embodiment 1 of the present invention. The liquid crystal display device 100 shown in FIG. 1 includes a timing control circuit 1, a frame memory 2, an orthogonal matrix generator 3, an orthogonal transformation circuit 4, a compensation arithmetic circuit 5, a selector circuit 6, a group 7 of row drivers, a group 8U of column drivers for the upper section of a screen, a group 8L of column drivers for the lower section of the screen, and a liquid crystal panel 9.

The timing control circuit 1 controls a timing for the entire system of the liquid crystal display device 100. Moreover, the timing control circuit 1 sets a compensation processing period required for performing the later-described compensation processing. Furthermore, the timing control circuit 1 controls the frame memory 2 and the selector circuit 6.

The frame memory 2 stores display data. The operation of the frame memory 2 will be described in detail hereinafter. Display data S101 is input to the frame memory 2 in a single scanning manner. Specifically, display data S101 is written to the frame memory 2 for every row. According to Embodiment 1 of the present invention, data displayed on one screen (i.e., the upper section of a screen) is display data of N rows×M columns. Since the liquid crystal display device 100 employs the multiline selection driving method, L row electrodes 91 are simultaneously selected. L×M display data corresponding to the selected L row electrodes 91 are read out. Specifically, L×M display data S201 in N×M display data for one screen (i.e., the upper section of a screen) is read out for every column, and then output to the orthogonal transformation circuit 4.

The orthogonal matrix generator 3 generates an orthogonal matrix whose dimension is L×L. An "orthogonal matrix" refers to a matrix wherein an arbitrary ith row and an arbitrary jth row are orthogonal with each other ($1 \leqq i \leqq L$, $1 \leqq j \leqq L$, $i \neq j$), and the ith column and the jth column are orthogonal with each other ($1 \leqq i \leqq L$, $1 \leqq j \leqq L$, $i \neq j$) among regular matrices (i.e., matrices having inverse matrices). The orthogonal matrix generator 3 outputs elements S301 in a column direction of the generated orthogonal matrix to the orthogonal transformation circuit 4 and the group 7 of row drivers at a timing when display data S201 is input to the orthogonal transformation circuit 4. A set of the elements in a column direction of the generated orthogonal matrix is referred to as a column vector S301. Column vector S301 corresponds to display data S201 which is read out from the frame memory 2. Dimensions of column vector S301 and display data S201 are L, respectively.

The orthogonal transformation circuit 4 receives column vector S301 and display data S201 which are output from the orthogonal matrix generator 3 and the frame memory 2, respectively. By using column vector S301 corresponding to display data S201, the orthogonal transformation circuit 4 performs orthogonal transformation of display data S201. The orthogonal transformation circuit 4 outputs arithmetic data S401, which is a result of the orthogonal transformation of display data S201, to the compensation arithmetic circuit 5 and the selector circuit 6.

The compensation arithmetic circuit 5 receives arithmetic data S401 which is output from the orthogonal transformation circuit 4. The compensation arithmetic circuit 5 calculates a compensation amount from the amount of a charge between the arithmetic data corresponding to some display data and the arithmetic data corresponding to another display data, and the direction of such a change. For example, a compensation amount may be calculated from the amount of a change between the arithmetic data corresponding to some display data and the arithmetic data corresponding to the display data one horizontal scanning period before and the direction of such a change. The compensation amount is output to the selector circuit 6 as compensation data S501.

Arithmetic data S401 (also referred to as a "display data signal") which is output from the orthogonal transformation circuit 4 and compensation data S501 (i.e., compensation data signal) which is output from the compensation arithmetic circuit 5 are input to the selector circuit 6. At this time, in response to the aforementioned compensation processing period, data signal S601 to be output to the group 8U of column drivers for the upper section of the screen is switched. Specifically, compensation data S501 is output to a corresponding one of the column drivers as a data signal S601 during a compensation processing period, and arithmetic data S401 is output to a corresponding one of the column drivers as display data signal S601 during a period in which display data is read out from the frame memory 2. For example, in the case of 1×Q compensation data S501, elements from 1st column to the Qth column may be output to the group 8 of column drivers in a sequential manner. In such a case, compensation voltages corresponding to elements of compensation data S501 are applied across the column electrodes, respectively, after a horizontal scanning period passed therefrom. During a period when the compensation voltages are being applied to the column electrodes, all of the row drivers apply a voltage at the time when the row electrodes are not selected to the row electrodes. Specifically, all of the row drivers do not output a selection pulse during the period when compensation voltages are applied to the column electrodes. In synchronization with a data transfer clock generated by the timing control circuit 1, data signal S601 is output.

Based on column vector S301 of an orthogonal matrix which is output from an orthogonal matrix generator 3, the group 7 of row drivers outputs a scanning voltage enough for L electrodes to the row electrodes 91 of the liquid crystal panel 9 such that the scanning voltage corresponds to data signal S601. Similarly, the group 8U of column drivers for the upper section of the screen applies a data voltage to the column electrodes 92 of the liquid crystal panel 9 based on data signal S601 which is output from the selector circuit 6.

A period during which no reading operation is performed is provided in a vertical scanning period in a period during which data is read out from the frame memory 2, and compensation processing is performed during such a period when no reading operation is performed. This period is referred to as a "compensation processing period" in this specification.

As shown in FIG. 1, the liquid crystal panel 9 is a dual-scan type liquid crystal panel wherein the panel is divided into two sections, i.e., the upper section of the panel and the lower section of the panel, and the two sections are driven independent of each other. N row electrodes are provided for each of the upper and lower sections of the panel 9. The group 7 of row drivers consists of a plurality of row drivers 7-1, 7-2, . . . , 7-Y depending on the number of the row electrodes 91, i.e., N. The group 7 of row drivers sequentially applies a voltage based on column vector S301 of an orthogonal matrix which is output from the orthogonal matrix generator 3 to the row electrodes 91 as a scanning voltage enough for simultaneously-selected L row electrodes. Similarly, the group 8U of column drivers for the upper section of the screen includes a plurality of column drivers 8U-1, 8U-2, . . . , 8U-X depending on the number of the column electrodes 92, i.e., M, and applies a data voltage based on display data signal S601 which is output from the selector circuit 6 to all of M column electrodes 92 simultaneously. Accordingly, the inverse transformation of display data is performed on the liquid crystal panel 9. Consequently, a display is realized in accordance with the inversely transformed display data.

The liquid crystal panel 9 according to Embodiment 1 is the same as that used in the conventional liquid crystal display device 100'. Specifically, the liquid crystal panel 9 has row electrodes 91 (the number of the row electrodes 91 is 2×N) and M column electrodes 92 which are arranged so as to cross the row electrodes 91. The intersections of the row electrodes 91 and the column electrodes 92 are arranged in a matrix. A liquid crystal layer (not shown) is interposed between the row electrodes 91 and the column electrodes 92, and each intersection of the row electrode 91 and the column electrode 92 respectively corresponds to each pixel. The liquid crystal layer in each of the pixels changes its optical state depending on a RMS voltage level for a driving voltage (i.e., a RMS value of the driving voltage) which is applied between the row electrodes 91 and the column electrodes 92. In this manner, display is performed. The liquid crystal panel 9 employed in Embodiment 1 is a dual-scan type liquid crystal panel wherein a screen is divided into two sections and each of the two sections is independently driven. Although the case where the upper section of the screen is driven will be described hereinafter, the same processing will be performed for the lower section of the screen.

The liquid crystal display device 100 differs from the conventional liquid crystal display device 100' in that the timing control circuit 1' of the conventional display device 100' is modified in the display device 100 of this invention and further includes the compensation arithmetic circuit 5 and the selector circuit 6 so that compensation processing is performed.

Each of driving circuits in the thus-structured liquid crystal display device 100 employing the multiline selection driving method will be described taking the case where the number of simultaneously-selected row electrodes is set to four as an example.

Figures 2A, 2B:
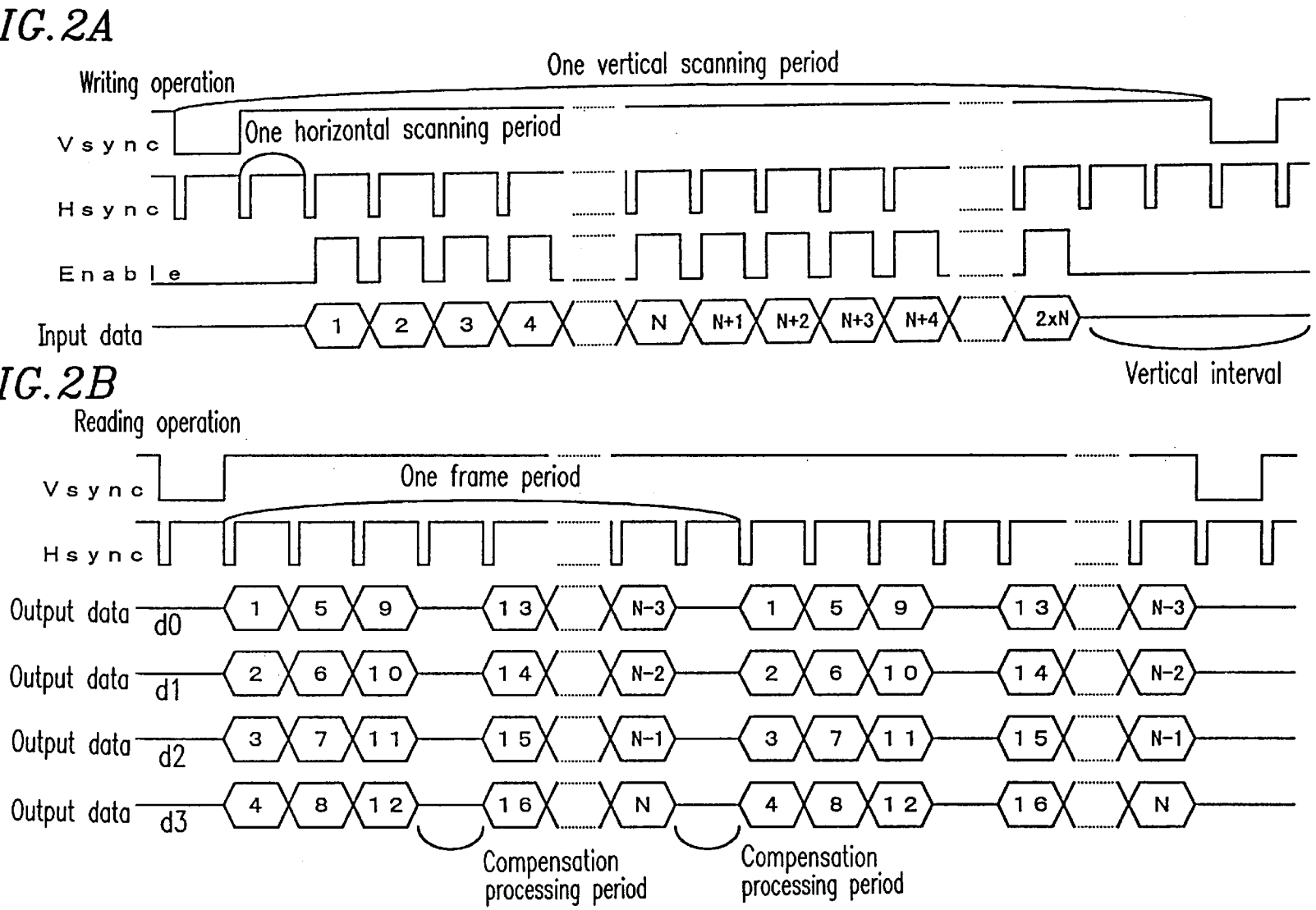
FIG. 2A is a timing chart showing timing for writing display data in a frame memory of the liquid crystal display device according to the present invention.
FIG. 2B is a timing chart showing timing for reading display data from the frame memory of the liquid crystal display device according to the present invention.

FIGS. 2A and 2B are timing charts showing control for operations of the frame memory 2. FIG. 2A is a timing chart for describing the writing operation to the frame memory 2. FIG. 2B is a timing chart for describing the reading operation from the frame memory 2. In FIGS. 2A and 2B, a "Vsync signal" refers to a vertical synchronous signal, and a "Hsync signal" refers to a horizontal synchronous signal. Both of these signals are input with display data S101. One cycle of the Vsync signal is referred to as "a vertical scanning period", and one cycle of the Hsync signal is referred to as "a horizontal scanning period".

As shown in FIG. 2A, in the case where display data for 2×N rows is input, an Enable signal indicating a period during which the display data is effective maintains a level H only during consecutive 2×N horizontal scanning periods in a vertical scanning period.

On the other hand, the number of Hsync signals is set so as have a number about 5 to 10% greater than the number of rows for normal display in consideration of the vertical interval of the CRT. In the same manner as in the conventional device 100', display data is written to the frame memory 2 in accordance with Enable signal. Display data is input to the frame memory 2 in a single scanning manner. Herein, input data from 1 to N is display data for the upper section of the screen, and input data from N+1 to 2×N is display data for the lower section of the screen.

FIG. 2B is a timing chart for describing the reading operation of display data for the upper section of the screen from the frame memory 2. Since the liquid crystal panel 9 employed in Embodiment 1 of the present invention is a dual-scan type panel wherein the upper section of the panel and the lower section of the panel are simultaneously driven, display data input in a single scanning manner is read out twice in one vertical scanning period if the reading operation is processed in the same clock frequency as that of the writing operation. Hereinafter, a reading period of display data read out at a time is referred to as "one frame period". For an every frame period, display data of four rows which are simultaneously selected is read out from the frame memory 2 four times, and output to the orthogonal transformation circuit 4. It is only required that the reading period has 2×N=((N rows/4 rows)×4 times×2 frames) horizontal scanning periods in one vertical scanning period, and these horizontal scanning periods are not necessarily continuous.

Therefore, a vertical interval which is continuously set upon writing can be dispersed almost equally by inserting a compensation processing period of 1 to 2 horizontal scanning period(s) once in predetermined horizontal scanning periods upon reading. The amount of compensation in each of horizontal scanning periods between two compensation processing periods is added together, and a voltage corresponding to the added compensation amount is applied every compensation processing period to the column electrodes. A compensation voltage level Vh applied for every compensation processing period equals a root-mean-square (RMS) of a compensation amount Vi for every horizontal scanning period. A RMS voltage level (i.e., effective voltage level) Vh can be calculated with the following Expression 3 using a time Th from a compensation processing period to a next compensation processing period.

[Expression 3] (3)

$$Vh = \sqrt{\frac{\sum Vi^2}{Th}}$$

As shown in FIG. 2B, a plurality of compensation processing periods are provided in one frame period. For example, 8 compensation processing periods may be provided in one frame period. If total time of compensation processing periods in one frame period becomes shorter, the effect of compensating the distortion of display data becomes smaller. Conversely, if the total time of compensation processing periods in one frame period becomes longer, the contrast of display data deteriorates. The length and the number of compensation processing periods in one frame period may be determined in consideration of the relative relationship between the compensation of the distortion of display data and the contrast of display data.

Figure 3:
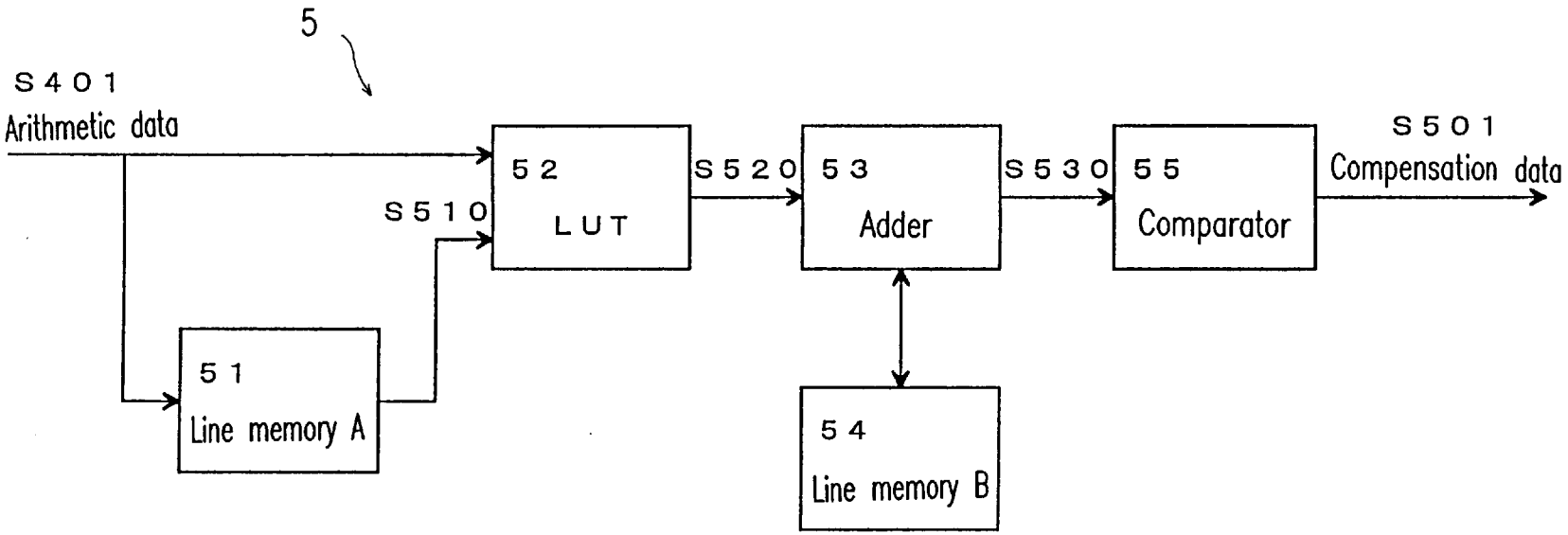
FIG. 3 is a diagram showing an exemplary compensation arithmetic circuit in the liquid crystal display device according to the present invention.

FIG. 3 shows the structure of the compensation arithmetic circuit 5. The compensation arithmetic circuit 5 calculates a compensation voltage represented by the aforementioned Expression 3. As shown in FIG. 3, the compensation arithmetic circuit 5 includes a line memory A 51, a look up table (hereinafter, referred to as a "LUT") 52, an adder 53, a line memory B 54, and a comparator 55.

First, a desired compensation value in a predetermined period is obtained using the line memory A 51, LUT 52, the adder 53, and the line memory B 54. The line memory A 51 and the LUT 52 output a square value $Vi^2$ of a compensation amount corresponding to a change in arithmetic data between two adjacent horizontal scanning periods. First, arithmetic data S401 which is output from the orthogonal transformation circuit 4 is input to the line memory A 51, and maintained for one horizontal scanning period. Sequentially input arithmetic data S401 and arithmetic data S510 (from one horizontal scanning period before, which is held at the line memory A 51), are input to the LUT 52. Next, square value S520 of a compensation amount based on a previously-provided loss-and-gain table of RMS voltage levels is output to the adder 53.

Figure 4:
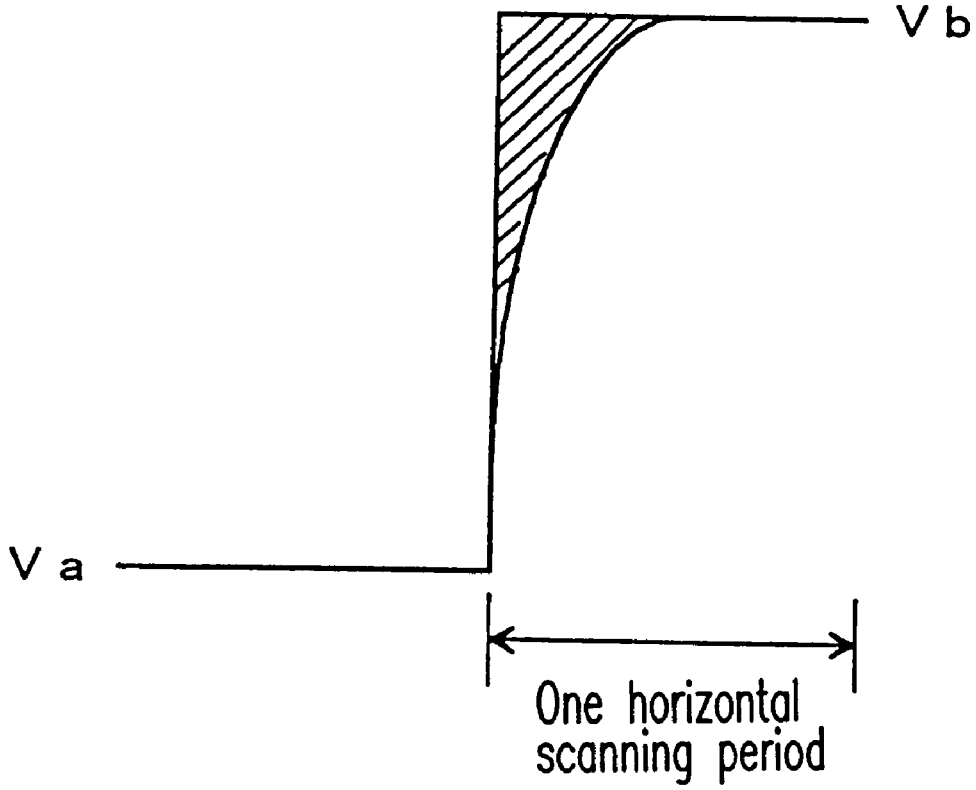
FIG. 4 is a view showing distortion of a waveform of a data voltage.

FIG. 4 is a diagram showing a waveform of a data voltage actually applied. FIG. 4 shows how a data voltage changes from an initial potential Va to a potential Vb after one horizontal scanning period. Herein, an area indicated by oblique lines represents a difference in RMS values (i.e., a difference in effective voltage levels) between an actual voltage waveform which takes distortion thereof into consideration and its ideal voltage waveform.

A voltage waveform which takes distortion thereof into consideration can be denoted by the following Expression 4.

[Expression 4] (4)

$$V(t) = (Vb - Va)\left(1 - e^{-\frac{t}{\tau}}\right)$$

Accordingly, the difference in RMS voltage level shown by the oblique lines can be calculated by the following Expression 5.

[Expression 5] (5)

$$Vi = \sqrt{\frac{1}{T}\left\{\int_0^T (Vb - Va)^2\,dt - \int_0^T (Vb - Va)^2\left(1 - e^{-\frac{t}{\tau}}\right)^2 dt\right\}}$$

Herein, $\tau$ is a time constant. A time constant is a value determined by a resistance component of an electrode, a capacitance component of a liquid crystal layer, and the like. In the expression 5, t represents a time which sets a timing for the start of a change in a potential from Va as 0.

Table 2 is a loss-and-gain table of RMS voltage levels obtained by the aforementioned Expression 5. Table 2 shows all possible states in the case where four row electrodes are simultaneously selected and driven. Herein, a positive value in the table refers to the addition of such a value since a RMS voltage level is reduced as compared to its ideal state. On the other hand, a negative value in the table refers to the subtraction of such a value since a RMS voltage level is increased as compared to its ideal state.

Table 2 shows that a compensation amount in accordance with a change in arithmetic data between two adjacent horizontal scanning periods maintains a proportional relationship. Each element of Table 2 is proportional to K shown below. If T is a constant, each element shown in the following Table 2 is proportional to $\sqrt{(\tau)}$.

TABLE 2

| | | Current data voltage | | | | |
|---|---|---|---|---|---|---|
| | | −2 Vc | −Vc | 0 | +Vc | +2 Vc |
| Data voltage one horizontal scanning period before | −2 Vc | 0 | $-\sqrt{5}$ KVc | −2 KVc | $\sqrt{3}$ KVc | 4 KVc |
| | −Vc | $\sqrt{7}$ KVc | 0 | −KVc | 2 KVc | $\sqrt{15}$ KVc |
| | 0 | $2\sqrt{3}$ KVc | $\sqrt{3}$ KVc | 0 | $\sqrt{3}$ KVc | $2\sqrt{3}$ KVc |
| | +Vc | $\sqrt{15}$ KVc | 2 KVc | −KVc | 0 | $\sqrt{7}$ KVc |
| | +2 Vc | 4 KVc | $\sqrt{3}$ KVc | −2 KVc | $-\sqrt{5}$ KVc | 0 |

In Table 2, $K=\sqrt{(\tau/(2T))}$. T is a data holding period after a potential change, and T equals one horizontal scanning period according to embodiment 1 of the present invention.

The LUT 52 is composed of a ROM or a logic circuit so as to output the square value of a compensation amount based on Table 2. One example of its truth value table is shown in Table 3.

TABLE 3

| | | Current arithmetic data (S401) | | | | |
|---|---|---|---|---|---|---|
| | | 000 | 001 | 010 | 011 | 100 |
| Arithmetic data one horizontal scanning period before (S510) | 000 | 0 | −5 | −4 | 3 | 16 |
| | 001 | 7 | 0 | −1 | 4 | 15 |
| | 010 | 12 | 3 | 0 | 3 | 12 |
| | 011 | 15 | 4 | −1 | 0 | 7 |
| | 100 | 16 | 3 | −4 | −5 | 0 |

In the same manner as that in Table 2, a positive value in Table 3 refers to the addition of such a value since a RMS voltage level is reduced as compared to its ideal state. A negative value in Table 3 refers to the subtraction of such a value since a RMS voltage level is increased as compared to its ideal state. 0 indicates that there is no increase or decrease in a RMS voltage level.

The adder 53 adds or subtracts the square values of the compensation amounts for horizontal scanning periods, which are output from the LUT 52, in a predetermined period from the end of a compensation processing period to the beginning of a next compensation processing period, and the line memory B 54 holds the result as the desired compensation value. For every compensation processing period, a total value S530 of square values of compensation amounts at that time, i.e., the value held by the line memory B 54 at that time, is output to the comparator 55.

The comparator 55 classifies the input total value S530 of the square values of the compensation amounts, i.e., the desired compensation value, into one of several cases in accordance with the number of display data voltage levels to be ultimately applied to the column electrodes. For example, in the case where four row electrodes are simultaneously selected and driven, total value S530 is classified into one of three cases, i.e., (1) no compensation voltage is applied; (2) ±Vc is applied; and (3) ±2Vc is applied.

Table 4 shows one example of such a classification. Herein, it is necessary to perform extraction of the square root of the total value S530 of the square values of the compensation amounts. In the logic circuit, however, such an extraction of the square root is not performed. Instead, the equivalent processing is performed by setting the threshold values, for classifying the total values S530 into three cases, to be $1^2:2^2$. At this time, the polarity of a compensation voltage is suitably inverted so that a direct current component is not applied across the liquid crystal panel.

TABLE 4

| | | Compensation data (S501) | |
|---|---|---|---|
| | | Polarity: − | Polarity: + |
| Sum of square values of compensation amounts (S530) | 0~S − 1 | 010 | 010 |
| | S~4 × S − 1 | 001 | 011 |
| | 4 × S~ | 000 | 100 |

Since the driving method in which four lines are simultaneously selected is used in Embodiment 1 of the present invention, the display data voltage can take five values, −2V, −V, 0, +V, and +2V, with respect to a non-selection voltage level of a scanning signal. A compensation voltage also uses these five values. In both of the cases where a compensation voltage is applied to a positive data voltage level and a compensation voltage is applied to a negative data voltage level, the RMS levels of the compensation voltages are equivalent as long as the absolute values of these compensation voltages are the same. Therefore, the types of compensation are three, i.e., 0, ±V, and ±2V.

Since value of a compensation amount stored in a memory in response to a change in a data voltage waveform is the square value of the RMS value of the required compensation voltage, it is necessary to derive the actual compensation voltage level by performing the extraction of the square root of the compensation amount data (i.e., the desired compensation value). (An appropriate compensation amount cannot be obtained by simply adding the amounts of the increases/decreases in the RMS value.)

If data of the compensation amount, which corresponds to the compensation voltage ±V, is supposed to be S, data of the compensation amount is in the range of 0 to S in the case where the absolute value of a compensation voltage level obtained by extracting the square root is in the range of 0 to V; data of the compensation amount is in the range of S to 4S in the case where the absolute value of a compensation voltage level is in the range of V to 2V; and data of the compensation amount is 4S or greater in the case where the absolute value of a compensation voltage level is 2V or greater. Specifically, without calculating a compensation voltage level by the extraction of the square root of the compensation amount data, it is possible to use the compensation amount data itself as a criterion of the compensation voltage level by using S and 4S as threshold values and making the following correspondences, i.e., the compensation voltage level is 0 when the compensation amount data is in the range of 0 to S; the compensation voltage level is V when the compensation amount data is in the range of S to 4S; and the compensation voltage level is 2V when the compensation amount data is 4S or greater. Accordingly, the comparator 55 selects a corresponding one of the predetermined compensation values (the threshold values) based on a desired compensation value, and outputs the compensation data S501 according to the selected predetermined compensation value.

After such a classification is performed, a value obtained by subtracting the predetermined threshold value used for the classification (i.e., S or 4×S) from the value before the classification (i.e., a desired compensation value) is added to a desired compensation value in the next compensation processing period in the line memory B 54. In this case, the line memory B 54 may be referred to as an offset circuit. Thereafter, compensation processing is repeated in the same manner as described above.

As described above, only three types of compensation can be performed in one compensation processing period. Although some of a compensation amount is left as an error, such a value is carried over to the next compensation processing period. In this manner, accuracy of the total compensation amount can be improved.

Arithmetic data S401 output from the orthogonal transformation circuit 4 and compensation data S501 output from the compensation arithmetic circuit 5 are input to the selector circuit 6. At this point, in response to a compensation processing period, the display data signal S601 to be output to the group 8 of column drivers is switched.

Figure 5:
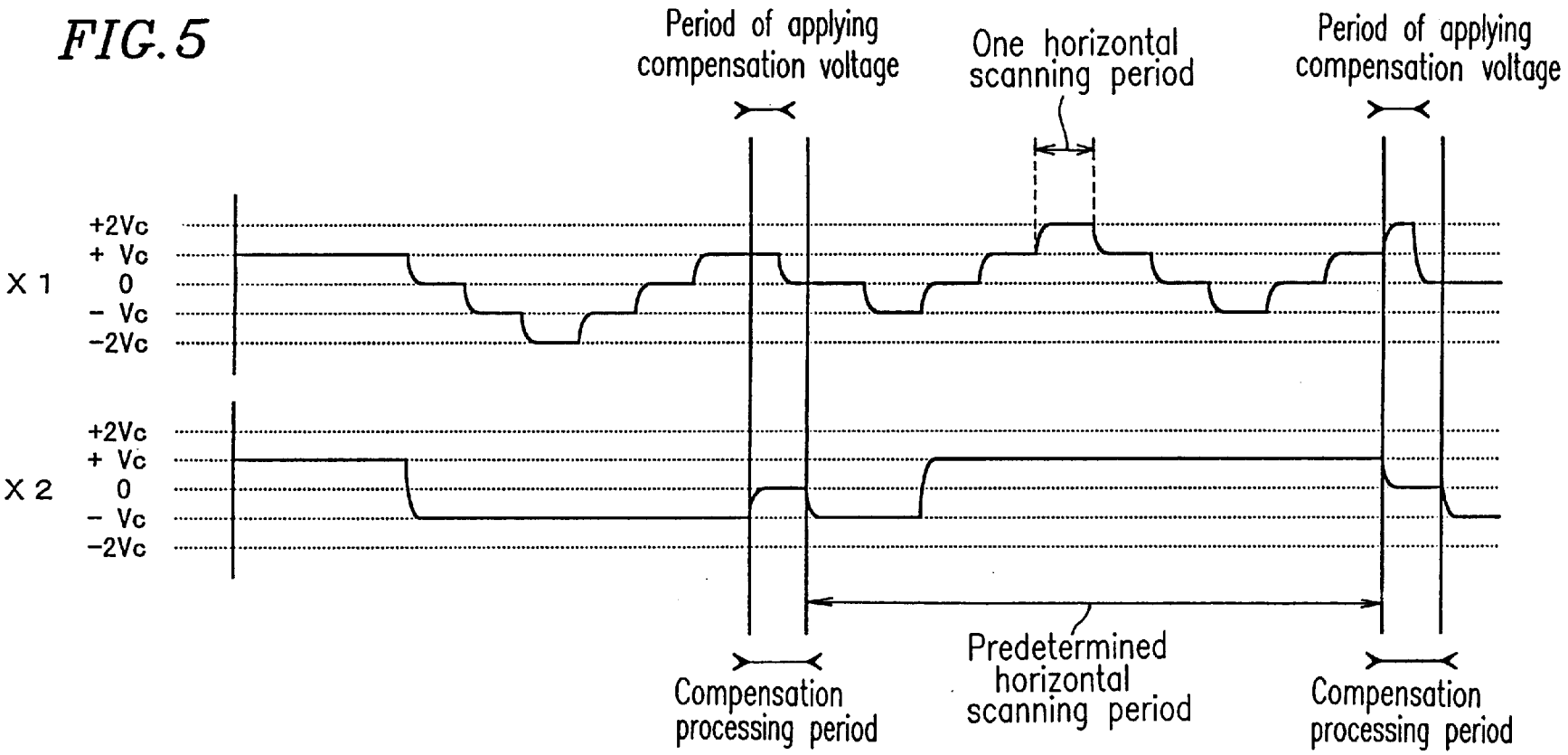
FIG. 5 is a diagram showing exemplary waveforms of data voltages.
Figure 6:
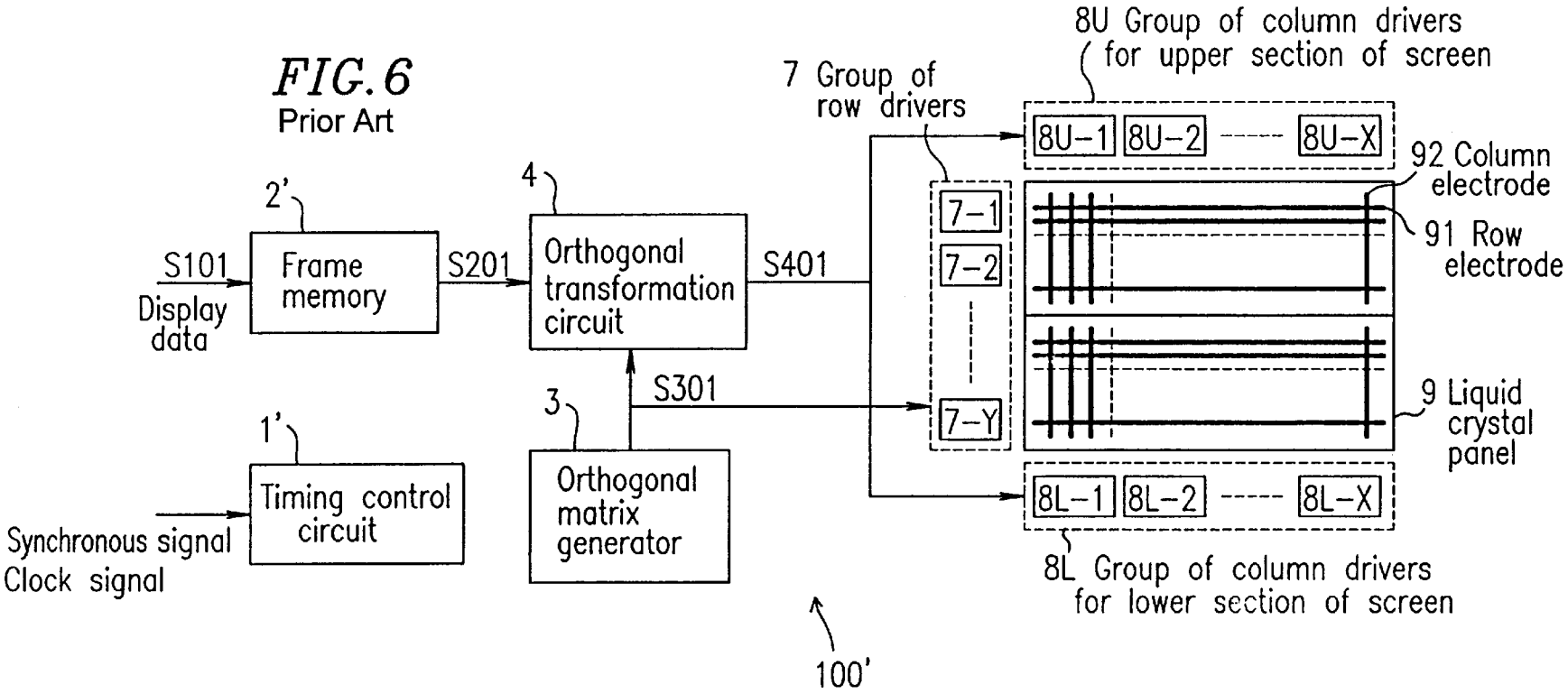
FIG. 6 Prior Art
FIG. 6 is a diagram showing a conventional liquid crystal display device.
Figure 7A:
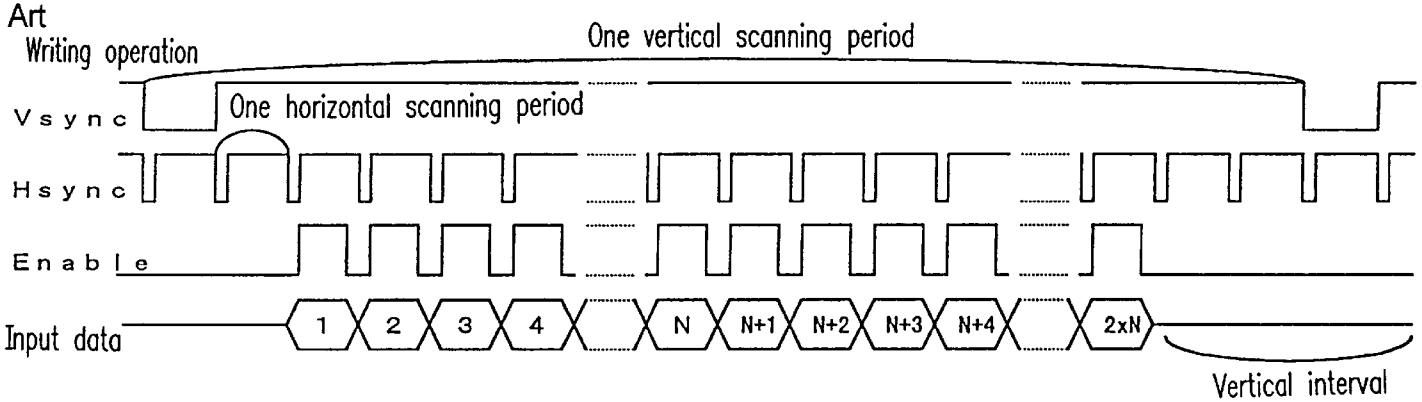
FIG. 7A Prior Art
FIG. 7A is a timing chart showing timing for writing display data in a frame memory of the conventional liquid crystal display device.
Figure 7B:
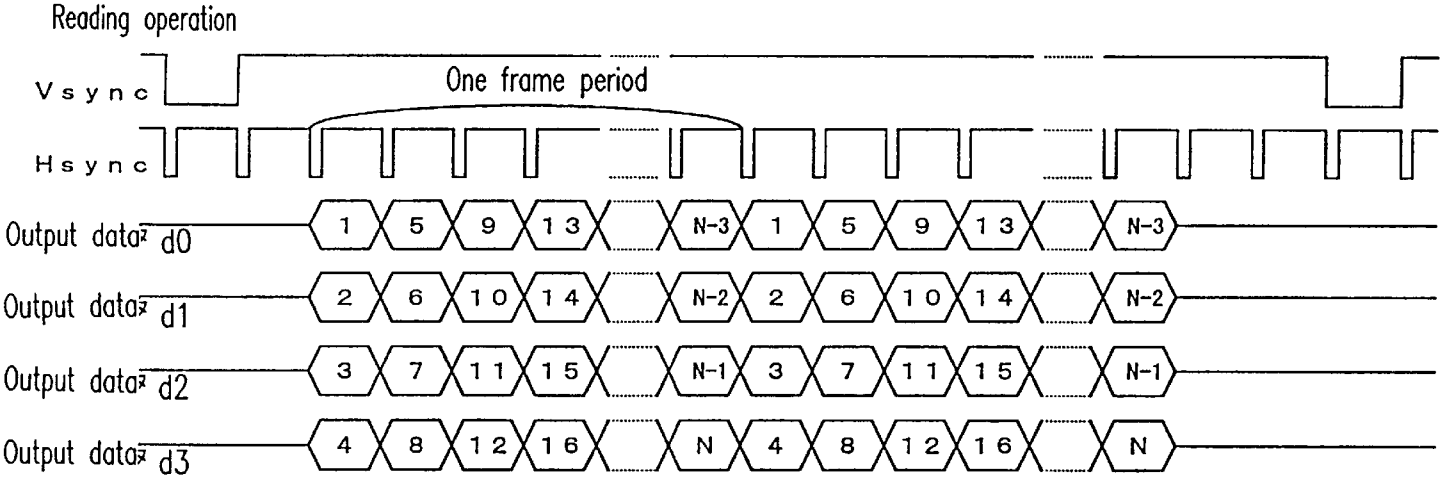
FIG. 7B Prior Art
FIG. 7B is a timing chart showing timing for reading display data from the frame memory of the conventional liquid crystal display device.
Figure 8:
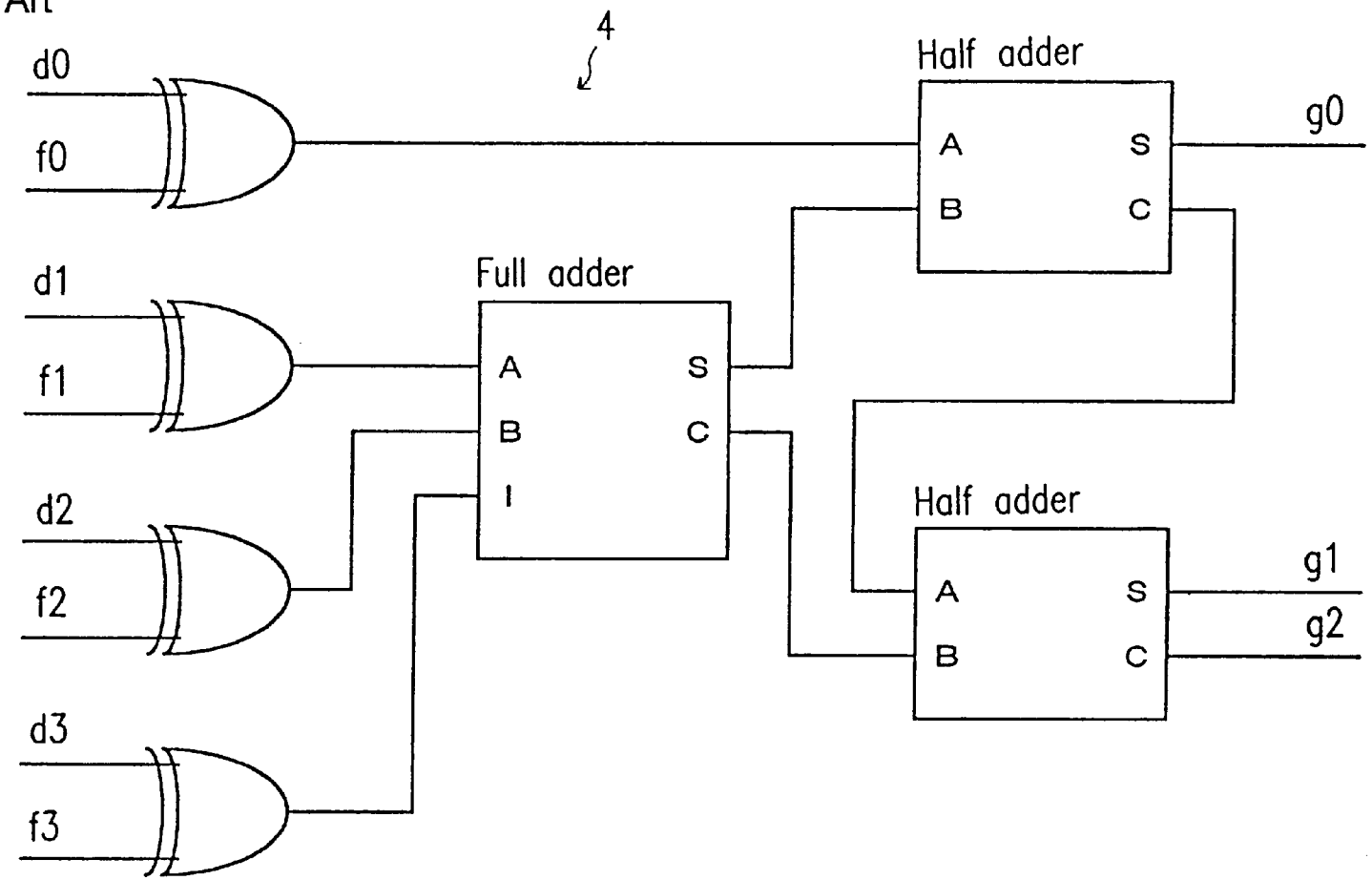
FIG. 8 Prior Art
FIG. 8 is a view showing an orthogonal arithmetic circuit.
Figure 10A:
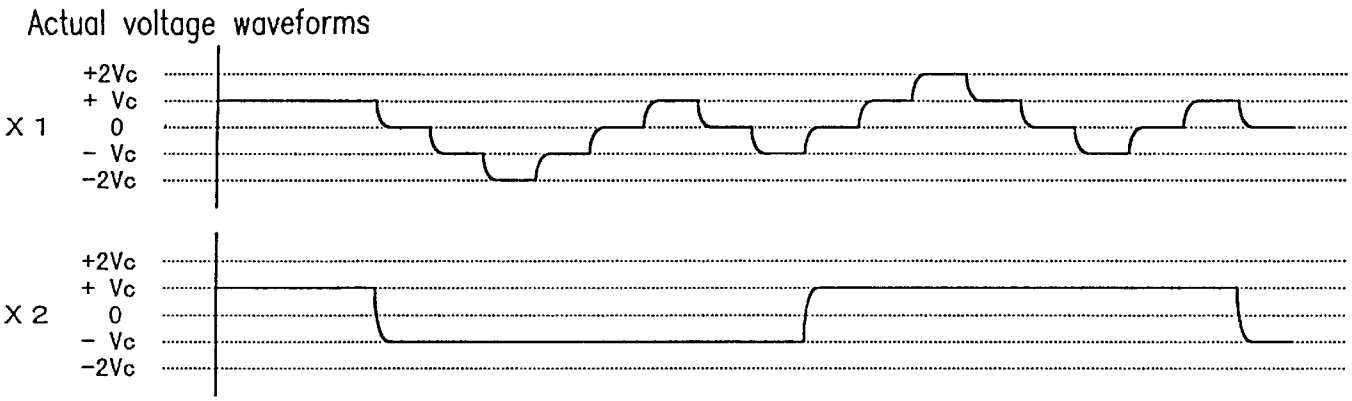
FIG. 10A Prior Art
FIG. 10A is a view showing exemplary actual waveforms of data voltages.
Figure 10B:
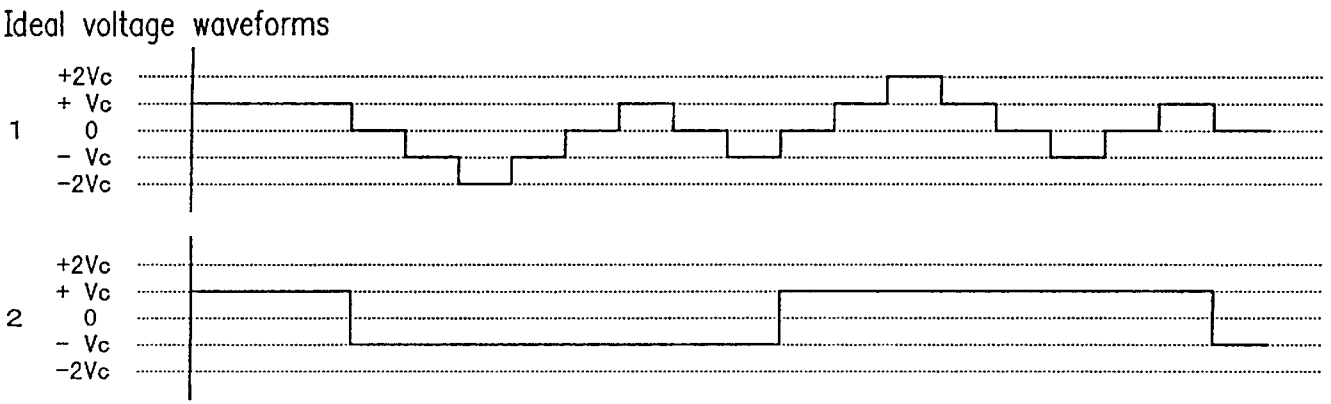
FIG. 10B Prior Art
FIG. 10B is a view showing exemplary ideal waveforms of the data voltages.

FIG. 5 shows exemplary data voltage waveforms according to Embodiment 1 of the present invention. FIG. 5 is a diagram for describing the state where the compensation voltages are applied across the actual data voltage waveforms shown in FIG. 10A.

Figure 9:
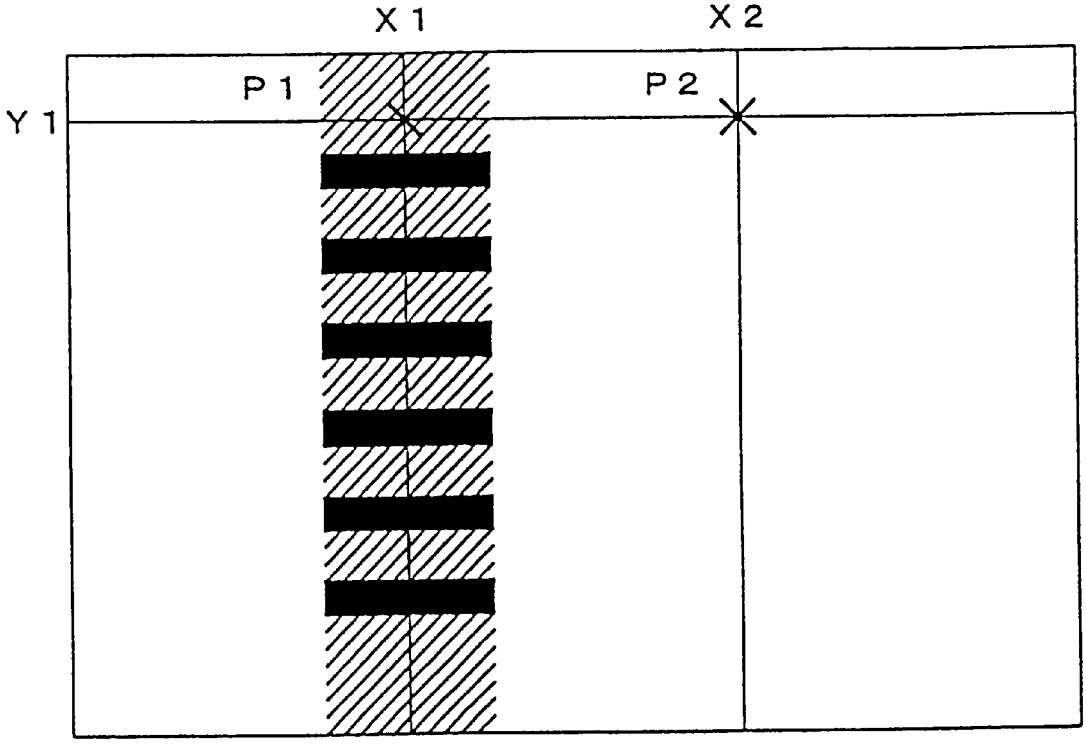
FIG. 9 Prior Art
FIG. 9 is a diagram showing a display pattern wherein cross-talk resulting from the distortion of a data voltage waveform occurs.

As described above, FIG. 10A shows actual voltage waveforms which are applied across the column electrodes X1 and X2 shown in FIG. 9. Due to the difference in display patterns, differences occur among distortion levels in waveforms of data voltages which are respectively applied across column electrodes. As a result, as shown in FIG. 9, even when the same bright state should be achieved at both of the pixels P1 and P2, the pixel P1 associated with the column electrode X1, which has a large distortion level in its data voltage waveform, has a reduced transmittance as compared to the pixel P2 associated with the column electrode X2, which has a smaller distortion level in its data voltage waveform. Due to the reduced transmittance, a display becomes dark. In this manner, cross-talk is more likely to occur in the pixel P1.

FIG. 5 shows actual voltage waveforms applied across the column electrodes X1 and X2 as shown in FIG. 9. In FIG. 5, a compensation processing period is provided between consecutive predetermined groups of horizontal scanning period, i.e., after a predetermined number of one-horizontal scanning period, and a compensation voltage is applied during such a compensation processing period. At this time, for the column electrode X1 which has a large distortion level in a data voltage waveform, the amount of a compensation voltage is increased, whereas for the column electrode X2 which has a small distortion level in a data voltage waveform, the amount of a compensation voltage is reduced. Accordingly, RMS voltage levels applied across the column electrodes can be made substantially equal.

Thus, according to Embodiment 1 of the present invention, it is possible to overcome cross-talk caused by a difference in distortion levels of the data voltage waveforms as shown in FIG. 9. Moreover, the absolute amount of compensation, which is proportional to a resistance component of an electrode in a liquid crystal panel, a capacitance component of a liquid crystal layer, or the like, can be more accurately obtained by adjusting a length of a period of applying a compensation voltage.

According to Embodiment 1 of the present invention, a plurality of compensation processing periods are provided in one frame. In other words, a plurality of compensation data are output from a compensation arithmetic circuit during one frame. Therefore, as compared to the case where only one compensation processing period is provided in one frame, a time between two compensation processing periods becomes shorter, and the amount of compensation performed in one compensation processing period thereby becomes smaller. As a result, the number of bits in the compensation amount data which has to be held in a memory can be reduced. Thus, a circuit size can be reduced in the liquid crystal display device according to Embodiment 1 of the present invention, thereby reducing its production cost. In the case where only one compensation processing period is provided in one frame, the amount of compensation performed in one compensation processing period is greater. Therefore, the number of bits in the compensation amount data which has to be held in a memory is increased. Thus, the cost of the memory is higher than it is in this embodiment.

In the case where a plurality of compensation processing periods are provided in one frame, data can be compensated a plurality of times. Therefore, the accuracy of compensation can be increased. On the other hand, in the case where only one compensation processing period exists in one frame, it is difficult to improve the accuracy of compensation.

In the thus-structured liquid crystal display device 100, experiments were performed using a color liquid crystal panel wherein the number of row electrodes N in each of the upper and lower sections of a screen was 300; the number of column electrodes M was 2400 (=800×RGB); the threshold voltage was 2.3 V; and the response speed ($\tau r+\tau d$) was 150 ms. The number of row electrodes simultaneously selected was four; a compensation processing period of one horizontal scanning period was provided once in every 38 horizontal scanning periods; and about one-third of the compensation processing period was set to be a period of actually applying a compensation voltage. As a result, such a liquid crystal display device was able to significantly reduce cross-talk, which depends on a display pattern, resulting from differences in distortion levels of waveforms applied to the column electrodes. Moreover, higher compensation accuracy was realized by optimizing the cycle of a compensation processing period, the value of LUT, the threshold value for classifying a compensation voltage, the period of applying a compensation voltage, and the like depending on the characteristics of the liquid crystal panel.

Embodiment 2

Hereinafter, a structure in which the same effects as those in Embodiment 1 can be obtained with a circuit smaller than that in Embodiment 1 will be described.

In each of the following Tables 5 to 8 LUT 52 is included in the compensation arithmetic circuit 5.

TABLE 5

| | | First frame | | | | |
|---|---|---|---|---|---|---|
| | | Current arithmetic data (S401) | | | | |
| | | 000 | 001 | 010 | 011 | 100 |
| Arithmetic data one horizontal scanning period before (S510) | 000 | 0 | −2 | −1 | 1 | 4 |
| | 001 | 2 | 0 | 0 | 1 | 4 |
| | 010 | 3 | 1 | 0 | 1 | 3 |
| | 011 | 4 | 1 | 0 | 0 | 2 |
| | 100 | 4 | 1 | −1 | −2 | 0 |

TABLE 6

| | | Second frame | | | | |
|---|---|---|---|---|---|---|
| | | Current arithmetic data (S401) | | | | |
| | | 000 | 001 | 010 | 011 | 100 |
| Arithmetic data one horizontal scanning period before (S510) | 000 | 0 | −1 | −1 | 0 | 4 |
| | 001 | 1 | 0 | 0 | 1 | 4 |
| | 010 | 3 | 1 | 0 | 1 | 3 |
| | 011 | 4 | 1 | 0 | 0 | 1 |
| | 100 | 4 | 0 | −1 | −1 | 0 |

TABLE 7

| | | Third frame | | | | |
|---|---|---|---|---|---|---|
| | | Current arithmetic data (S401) | | | | |
| | | 000 | 001 | 010 | 011 | 100 |
| Arithmetic data one horizontal scanning period before (S510) | 000 | 0 | −1 | −1 | 1 | 4 |
| | 001 | 2 | 0 | 0 | 1 | 3 |
| | 010 | 3 | 0 | 0 | 0 | 3 |
| | 011 | 3 | 1 | 0 | 0 | 2 |
| | 100 | 4 | 1 | −1 | −1 | 0 |

TABLE 8

| | | Fourth frame | | | | |
|---|---|---|---|---|---|---|
| | | Current arithmetic data (S401) | | | | |
| | | 000 | 001 | 010 | 011 | 100 |
| Arithmetic data one horizontal scanning period before (S510) | 000 | 0 | −1 | −1 | 1 | 4 |
| | 001 | 2 | 0 | −1 | 1 | 4 |
| | 010 | 3 | 1 | 0 | 1 | 3 |
| | 011 | 4 | 1 | −1 | 0 | 2 |
| | 100 | 4 | 1 | −1 | −1 | 0 |

The four LUTs from Tables 5 to 8 are obtained by dividing the LUT shown in Table 3 of Embodiment 1 into four frames. The total value of each matrix element for the four frames is equal to the value of respective matrix element in Table 3. In this manner, by selecting the LUT to be referred to for every frame by a selection circuit (not shown), the number of bits in the LUT 52 of the compensation arithmetic circuit 5 can be reduced by two bits. Moreover, in the following processing in the adder 53, the line memory B 54, and the comparator 55, the number of bits can be also reduced by two bits.

Accordingly, circuit sizes in the adder 53, the line memory B 54, and the comparator 55 can be reduced, thereby further reducing the cost of the liquid crystal display device. There exist many methods for dividing a LUT into several frames. As one example of such methods, Tables 5 to 8 show the best method among our experimental results. The same effects as those in Embodiment 1 can be obtained in Embodiment 2 of the present invention.

Although exemplary liquid crystal display devices are described by way of Embodiments 1 and 2, the structure of the present invention is not limited to those embodiments. For example, although two line memories are provided in the compensation arithmetic circuit in the aforementioned embodiments, the same processing as described above can be performed by using only one frame memory.

The present invention is effective for cross-talk caused by a change in a data voltage waveform not only in a liquid crystal display device capable of performing two-gray-scale display including a gray-scale display by frame rate control but also in a liquid crystal display device whose gray-scale process is pulse width modulation, frequency modulation, or the like.

There are two types of cross-talk caused by a change in a data voltage waveform, i.e., cross-talk caused by waveform distortion and cross-talk resulting from distortion induced toward the side of row electrodes. In the aforementioned embodiments, the present invention is described taking the former case as an example. However, the present invention can be applied to the latter kind of cross-talk in the same manner as that described above. The present invention can also be applied to the case where the two kinds of cross-talk exist at the same time.

In Embodiments 1 and 2, the present invention is applied to the liquid crystal display device employing the multiline selection driving method. However, the present invention can be effectively applied to a liquid crystal display device employing the conventional line-sequential driving method.

As described above, according to the present invention, it is possible to realize a liquid crystal display device capable of remarkably reducing cross-talk which significantly deteriorates a display quality. This is accomplished by a circuit for compensating the amount of an increase or decrease in a RMS voltage level due to a change in a waveform of a voltage applied to each column electrode, in the case where a data voltage waveform applied across the liquid crystal panel changes due to its display pattern. Moreover, since compensation is performed such that the effective level of a data voltage waveform after compensation processing and that of its ideal voltage waveform are equivalent, contrast ratio can be improved as compared to the conventional methods for reducing cross-talk.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A liquid crystal display device which includes a plurality of row electrodes to which a scanning voltage is applied; a plurality of column electrodes provided so as to cross the plurality of row electrodes and having a display data voltage applied thereto; and a liquid crystal layer interposed between the plurality of row and column electrodes, the liquid crystal layer providing a display function at intersections between the plurality of row and column electrodes in response to a root mean square (RMS) value of a voltage applied between the plurality of row and column electrodes, the liquid crystal display device further comprising:

a section for outputting a display data signal representing the display data voltage;

a compensation circuit for outputting a compensation data signal based on a RMS value difference between an ideal RMS value of the display data voltage and an actual RMS value of the display data voltage applied to the plurality of column electrodes; and a driving circuit for applying a compensation voltage during a compensation period to at least one of the plurality of column electrodes based on the compensation data signal.

2. A liquid crystal display device according to claim 1, wherein the compensation circuit includes a compensation value circuit for generating a desired compensation value corresponding to a predetermined period based on a level and a direction of change in the display data voltage, and wherein the compensation data signal is output based on the desired compensation value.

3. A liquid crystal display device according to claim 1, wherein the compensation circuit includes a comparison circuit for selecting a first predetermined compensation value corresponding to the compensation data signal based on a first desired compensation value during a first compensation processing period and an offset circuit for adding a difference between the first selected predetermined compensation value and the first desired compensation value to a second desired compensation value during a second compensation processing period.

4. A liquid crystal display device according to claim 1, wherein the driving circuit applies the compensation voltage during a predetermined period of time.

5. A liquid crystal display device according to claim 1, wherein the compensation circuit further includes:

a plurality of lookup tables for determining a compensation amount based on the RMS value difference between the ideal RMS value and the actual RMS value of the display data voltage, and a selection circuit for selecting the compensation data signal for every compensation processing period.

6. A liquid crystal display device which includes: a plurality of row electrodes to which a scanning voltage is applied; a plurality of column electrodes provided so as to cross the plurality of row electrodes and having a display data voltage applied thereto; and a liquid crystal layer interposed between the plurality of row and column electrodes, the liquid crystal layer providing a display function at intersections between the plurality of row and column electrodes in response to a root mean square value of a voltage applied between the plurality of row and column electrodes, the liquid crystal display device further comprising:

a compensation circuit for outputting a compensation data signal during a compensation period for compensating for a change in a RMS value caused by a waveform change based on a RMS value difference between an ideal RMS value of the display data voltage and an actual RMS value of the display data voltage applied to the plurality of column electrodes; and a data output circuit for outputting a display data signal and the compensation data signal to a driving circuit for at least one of the plurality of column electrodes during one frame period.

7. A liquid crystal display device according to claim 6, wherein a plurality of the compensation data signals are output during the one frame period.

8. A liquid crystal display device according to claim 6, wherein the compensation voltage and the display data voltage have a plurality of same voltage levels.

9. A liquid crystal display device according to claim 6, wherein the driving circuit applies the compensation voltage during a predetermined period of time.

* * * * *